US012765626B2

(12) United States Patent
Wikner

(10) Patent No.: US 12,765,626 B2
(45) Date of Patent: Oct. 20, 2026

(54) HELMET AND DEVICE FOR HELMET

(71) Applicant: MIPS AB, Täby (SE)

(72) Inventor: Jakob Wikner, Täby (SE)

(73) Assignee: MIPS AB, Täby (SE)

( * ) Notice: Subject to any disclaimer, the term of this patent is extended or adjusted under 35 U.S.C. 154(b) by 0 days.

(21) Appl. No.: 18/289,758

(22) PCT Filed: May 25, 2022

(86) PCT No.: PCT/EP2022/064326
§ 371 (c)(1),
(2) Date: Nov. 7, 2023

(87) PCT Pub. No.: WO2022/248619
PCT Pub. Date: Dec. 1, 2022

(65) Prior Publication Data

US 2024/0277097 A1 Aug. 22, 2024

(30) Foreign Application Priority Data

May 26, 2021 (GB) ..... 2107474

(51) Int. Cl.
*A42B 3/14* (2006.01)
*A42B 3/06* (2006.01)

(52) U.S. Cl.
CPC ..... *A42B 3/14* (2013.01); *A42B 3/064* (2013.01); *A42B 3/069* (2013.01)

(58) Field of Classification Search
CPC .. A42B 3/14; A42B 3/069; A42B 3/10; A42B 3/063; A42B 3/064; A42B 3/08; A42B 3/085
See application file for complete search history.

(56) References Cited

U.S. PATENT DOCUMENTS 3,280,406 A * 10/1966 Immel ..... A42C 5/02 2/181
3,577,562 A * 5/1971 Holt ..... A42B 3/10 2/909

(Continued)

FOREIGN PATENT DOCUMENTS

CN 102811639 A 12/2012
CN 102905570 A 1/2013

(Continued)

OTHER PUBLICATIONS

First Notification of Chinese Office Action for Application No. 202280037922.2, dated Sep. 8, 2025. (18 pages including translation).

(Continued)

*Primary Examiner* — Aiying Zhao
(74) *Attorney, Agent, or Firm* — Husch Blackwell LLP

(57) ABSTRACT

A helmet, comprising: an outer shell; a head mount, configured to be mounted on the top of the head of a wearer of the helmet, wherein the head mount is suspended within the outer shell such that, in use, an air gap is provided between head mount and the outer shell; a head mount cover, covering a first surface of the head mount and at least partially surrounding the head mount; wherein a low friction interface is provided between the head mount cover and the first surface of the head mount.

15 Claims, 9 Drawing Sheets

(56) References Cited

U.S. PATENT DOCUMENTS

| | | | | | |
|---|---|---|---|---|---|
| 3,906,548 | A * | 9/1975 | Kallis | A42B 3/14 2/416 |
| 4,675,919 | A * | 6/1987 | Heine | A61B 90/50 2/181 |
| 5,826,279 | A * | 10/1998 | Tencer | A42B 3/10 2/416 |
| 2006/0010579 | A1 * | 1/2006 | Wiles | A42B 3/14 2/410 |
| 2011/0167532 | A1 | 7/2011 | Carlson | |
| 2013/0042397 | A1 | 2/2013 | Haldin | |
| 2019/0328074 | A1 | 10/2019 | Pomering et al. | |
| 2020/0026813 | A1 | 1/2020 | Hiraoglu et al. | |
| 2020/0187584 | A1 | 6/2020 | Thiel | |
| 2020/0260813 | A1 | 8/2020 | Pomering | |

FOREIGN PATENT DOCUMENTS

| | | | | |
|---|---|---|---|---|
| CN | 207653662 | U | 7/2018 | |
| CN | 209931610 | U | 1/2020 | |
| CN | 110913714 | A | 3/2020 | |
| EP | 3391765 | A2 | 10/2018 | |
| FR | 2566632 | A1 | 1/1986 | |
| GB | 735389 | A | 8/1955 | |
| TW | 201735810 | A | 10/2017 | |
| TW | 202106192 | A | 2/2021 | |
| WO | 2001/045526 | A1 | 6/2001 | |
| WO | 2011/139224 | A1 | 11/2011 | |
| WO | 2013104505 | A1 | 7/2013 | |
| WO | 2017/148958 | A1 | 9/2017 | |
| WO | 2017157765 | A1 | 9/2017 | |
| WO | WO-2020078913 | A1 * | 4/2020 | A42B 3/064 |
| WO | 2020/115063 | A1 | 6/2020 | |
| WO | 2020/260185 | A1 | 12/2020 | |

OTHER PUBLICATIONS

Chinese Office Action and Search Report for Application No. 202280037922.2 dated Jan. 13, 2026 (10 pages with English Translation).

UKIPO Search Report for Application No. GB2107474.5, dated Nov. 10, 2021, 1 page.

* cited by examiner

HELMET AND DEVICE FOR HELMET

RELATED APPLICATIONS

This application is a 35 USC § 371 National Stage application of International Application No. PCT/EP2022/064326, entitled "HELMET AND DEVICE FOR HELMET," filed on May 25, 2022, which claims the benefit of United Kingdom Patent Application No. 2107474.5, filed May 26, 2021, which are hereby incorporated by reference herein in their entirety.

TECHNICAL FIELD

The present invention relates to a helmet and a device for a helmet.

BACKGROUND ART

Impact protection apparatuses generally aim to reduce the energy transferred to an object, such as a person to be protected, by an impact. This may be achieved by energy absorbing means, energy redirecting means, or a combination thereof. Energy absorbing means may include energy absorbing materials, such as a foam materials, or structures configured to deform elastically and/or plastically in response to an impact. Energy redirecting means may include structures configured to slide, shear or otherwise move in response to an impact.

Impact protection apparatuses include protective apparel for protecting a wearer of the apparel. Protective apparel comprising energy absorbing means and/or energy redirecting means is known. For example, such means are implemented extensively in protective headgear, such as helmets.

Examples of helmets comprising energy absorbing means and energy redirecting means include WO 2001/045526 and WO 2011/139224 (the entirety of which are herein incorporated by reference). Specifically, these helmets include at least one layer formed from an energy absorbing material and at least one layer that can move relative to the head of the wearer of the helmet under an impact.

Implementing moving parts in a helmet has challenges. For example, ensuring that friction between moving parts under an impact can be overcome to allow enough relative movement between parts can be challenging. Ensuring that the helmet can be manufactured and assembled relatively easily can be challenging.

It is the aim of the present invention to provide a helmet that at least partially addresses some of the problems discussed above.

SUMMARY OF THE INVENTION

According to an aspect of the disclosure there is provided a helmet, comprising: an outer shell; a head mount, configured to be mounted on the top of the head of a wearer of the helmet, wherein the head mount is suspended within the outer shell such that, in use, an air gap is provided between head mount and the outer shell; a head mount cover, covering a first surface of the head mount and at least partially surrounding the head mount; wherein a low friction interface is provided between the head mount cover and the first surface of the head mount.

Optionally, the head mount cover is deformable, such that the head mount cover can move relative to the head mount at the low friction interface. Optionally, the head mount cover comprises a first layer arranged to cover the first surface of the head mount. Optionally, the first layer comprises a fabric. Optionally, the fabric is stretchable.

Optionally, the head mount cover comprises a second layer arranged to at least partially cover a second surface of the head mount on an opposite side of the head mount to the first surface, and connected to the first layer. Optionally, the second layer comprises a fabric. Optionally, the fabric is stretchable.

Optionally, the head mount cover comprises a third layer arranged between the first layer and the first surface of the head mount, part of the low friction interface being provided by the third layer. Optionally, the third layer comprises a low friction material. Optionally, the low friction material is PC, TPU or Nylon. Alternatively, the low friction material is a fabric. Optionally, the first layer and third layer of the head mount cover comprise a ribbed fabric and are arranged such that the rib directions are perpendicular to each other, thus forming the low friction interface therebetween. Optionally, the ribbed fabric is a tricot fabric.

Optionally, the head mount comprises a plurality of straps that are configured to extend across the top of the head of a wearer of the helmet and are connected to connection points on the outer shell. Optionally, the head mount comprises a plurality of straps that extend between an opposing pair of connection points. Optionally, at least two straps are connected to each other. Optionally, the head mount cover surrounds each of the straps. Optionally, the head mount cover comprises a central region, and a plurality of arms extending outward from the central region located to correspond with the plurality straps, the central region located to correspond with a location of convergence or crossing of the straps.

Optionally, the head mount is located within the head mount cover, and the head mount cover comprises an opening through which the head mount can be inserted and/or removed.

Optionally, the head mount cover is provided as a single component.

Optionally, the head mount cover is formed from plural separate sections.

Optionally, the head mount comprises a head ring that is configured to engage at least the forehead of a wearer of the helmet; and the head mount cover comprises a frontal region that is configured to cover the head ring.

Optionally, the head mount cover comprises one or more pads provided on a surface of the head mount cover facing the head of a wearer of the helmet.

Optionally, in the absence of an impact on the helmet, the separation between the outer shell and the head mount at a location corresponding to the top of the head of a wearer provided by the air gap is at least 10 mm, optionally at least 15 mm, optionally at least 20 mm, optionally at least 30 mm, optionally at least 40 mm.

According to an aspect of the disclosure there is provided a head mount cover for use with a helmet comprising an outer shell and a head mount, the head mount being configured to be mounted on the top of the head of a wearer of the helmet, wherein the head mount is suspended within the outer shell such that, in use, an air gap is provided between head mount and the outer shell; the head mount cover being configured to cover a first surface of the head mount and to at least partially surround the head mount: the head mount cover being configured to provide a low friction interface between the head mount cover and the first surface of the head mount.

BRIEF DESCRIPTION OF THE DRAWINGS

The invention is described in detail below, with reference to the accompanying figures, in which.

DETAILED DESCRIPTION

It should be noted that the Figures are schematic, the proportions of the thicknesses of the various layers, and/or of any gaps between layers, depicted in the Figures may have been exaggerated or diminished for the sake of clarity and can of course be adapted according to need and requirements.

General features of the example helmets are described below with reference to FIGS. 1 to 4.

FIGS. 1 to 4 show example helmets 1 comprising an outer layer 2, or shell. The purpose of the outer layer 2 may be to provide rigidity to the helmet. This may help spread the impact energy over a larger area of the helmet 1. The outer layer 2 may also provide protection against objects that might pierce the helmet 1. Accordingly, the outer layer 2 may be a relatively strong and/or rigid layer, e.g. compared to an energy absorbing layer 3. The outer layer 2 may be a relatively thin layer, e.g. compared to an energy absorbing layer 3.

The outer layer 2 may be formed from a relatively strong and/or rigid material. Preferable such materials include a polymer material such as polycarbonate (PC), polyvinylchloride (PVC), high density polyethylene (HDPE) or acrylonitrile butadiene styrene (ABS) for example. Advantageously, the polymer material may be fibre-reinforced, using materials such as glass-fibre, Aramid, Twaron, carbon-fibre and/or Kevlar.

Figure 4:
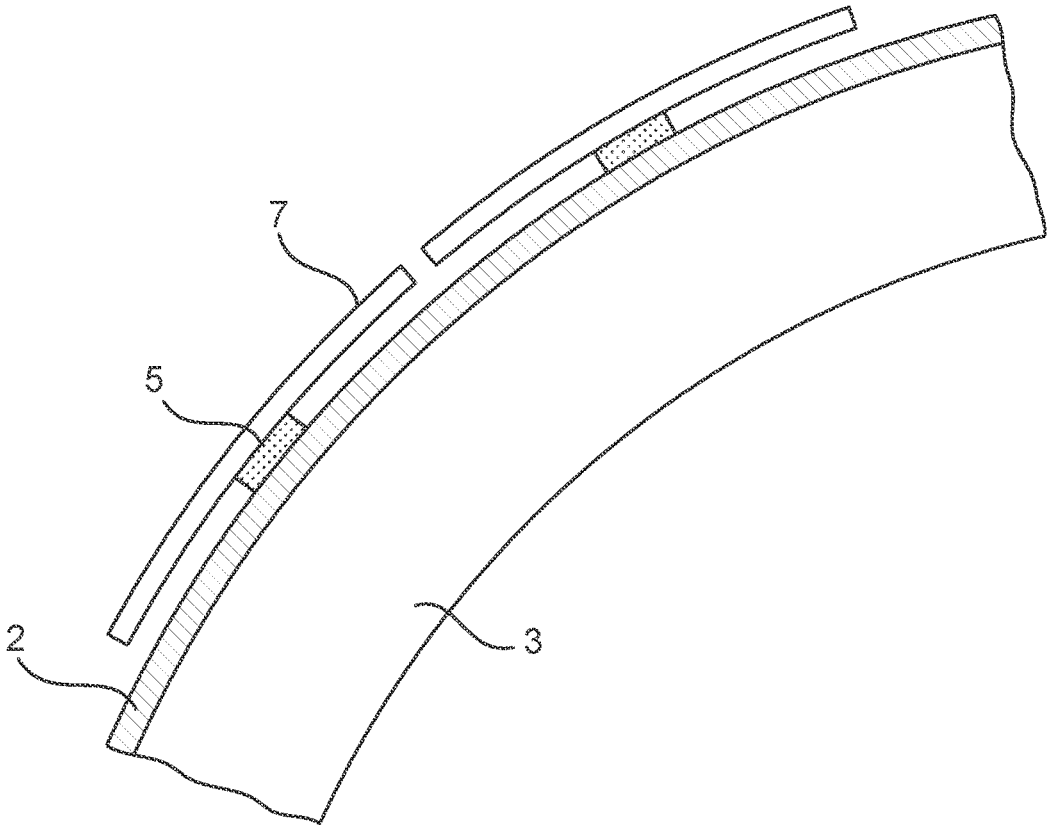
FIG. 4 schematically shows a cross-section through a fourth example helmet.

As shown in FIG. 4, one or more outer plates 7 may be mounted to the outer layer 2 of the helmet 1. The outer plates 7 may be formed from a relatively strong and/or rigid material, for example from the same types of materials as from which the outer layer 2 may be formed. The selection of material used to form the outer plates 7 may be the same as, or different from, the material used to form the outer layer 2.

The helmet of FIG. 4 is configured such that the outer plates 7 are able to slide relative to the outer layer 2 in response to an impact. A sliding interface may be provided between the outer plates 7 and the outer layer 2.

Friction reducing means, to reduce the friction at the sliding interface, may be provided by forming the outer layer 2 and/or the outer plates 7 from a low friction material, providing an additional low friction layer on a surface of the outer layer 2 and/or the outer plates 7 facing the sliding interface, by applying a low friction coating to the outer layer 2 and/or the outer plates 7, and/or applying a lubricant to the outer layer 2 and/or the outer plates 7.

The helmet 1 shown in FIG. 4 also comprises connectors 5 attached to the outer plates 7 The connectors 5 are also attached to the outer layer 2 to allow relative sliding between the plates 7 and the outer layer 2. Alternatively or additionally, one or more of the connectors 5 may be connected to another part of the remainder of the helmet 1, such as an energy absorbing layer 3. The connectors 5 may also be connected to two or more parts of the remainder of the helmet 1.

In such an arrangement, in the event of an impact on the helmet 1, it can be expected that the impact would be incident on one or a limited number of the outer plates 7. Therefore, by configuring the helmet such that the one or more outer plates 7 can move relative to the outer layer 2 and any outer plates 7 that have not been subject to an impact, the surface receiving the impact, namely one or a limited number of outer plates 7, can move relative to the remainder of the helmet 1. In the case of an impact, this may reduce the rotational acceleration of the head of a wearer.

It should be understood that such an arrangement of outer plates 7 may be added to any helmet described herein.

Figure 2:
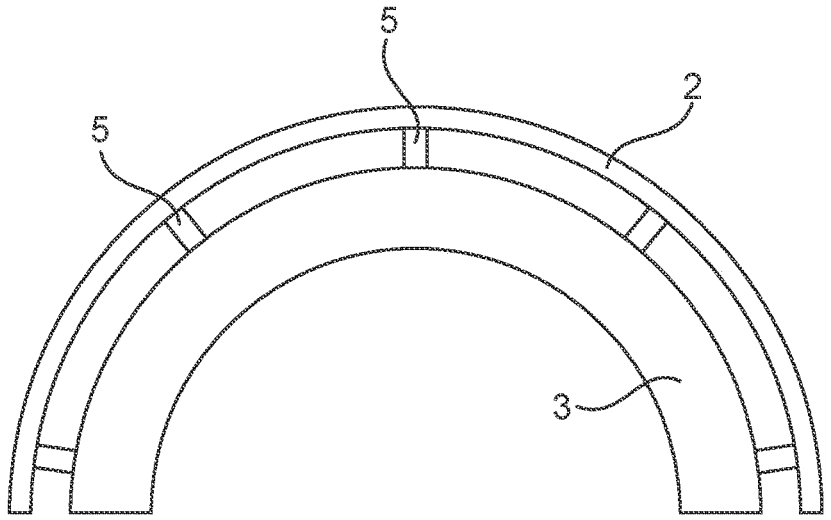
FIG. 2 schematically shows a cross-section through a second example helmet.
Figure 3:
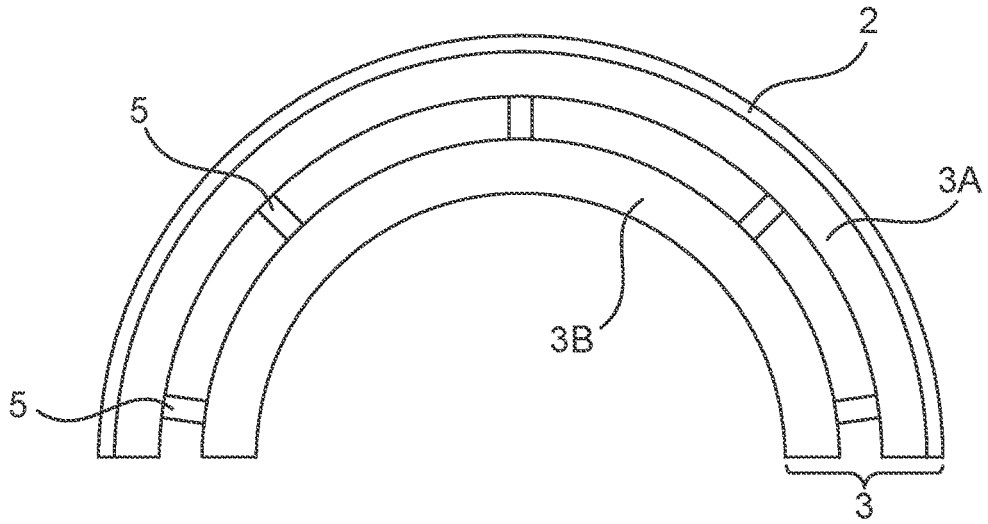
FIG. 3 schematically shows a cross-section through a third example helmet.

FIGS. 2 to 4 show example helmets 1 comprising an optional energy absorbing layer 3. The purpose of the energy absorbing layer 3 is to absorb and dissipate energy from an impact in order to reduce the energy transmitted to the wearer of the helmet. Within the helmet 1, the energy absorbing layer may be the primary energy absorbing element. Although other elements of the helmet 1 may absorb that energy to a more limited extent, this is not their primary purpose.

The energy absorbing layer 3 may absorb energy from a radial component of an impact more efficiently than a tangential component of an impact. The term "radial" generally refers to a direction substantially toward the centre of the wearers head, e.g. substantially perpendicular to an outer surface of the helmet 1. The term "tangential" may refer to a direction substantially perpendicular to the radial direction, in a plane comprising the radial direction and the impact direction.

The energy absorbing layer may be formed from an energy absorbing material, such as a foam material. Preferable such materials include expanded polystyrene (EPS), expanded polypropylene (EPP), expanded polyurethane (EPU), vinyl nitrile foam; or strain rate sensitive foams such as those marketed under the brand-names Poron™ and D3O™.

Alternatively, or additionally, the energy absorbing layer may have a structure that provides energy absorbing characteristics. For example, the energy absorbing layer may comprise deformable elements, such as cells or finger-like projections, that deform upon impact to absorb and dissipate the energy of an impact.

As illustrated in FIG. 3, the energy absorbing layer 3 of the helmet 1 may be divided into outer and inner parts 3A, 3B. These parts 3A, 3B may be configured to rotate relative to each other.

The energy absorbing layer is not limited to one specific arrangement or material. The energy absorbing layer 3 may be provided by multiple layers having different arrangements, i.e. formed from different materials or having different structures. The energy absorbing layer 3 may be a relatively thick layer. For example, it may be thickest layer of the helmet 1.

Where used, the energy absorbing material layer may be provided as a shell over substantially all of the surface of the hard shell facing the wearer's head, although ventilation holes may be provided. Alternatively or additionally, localised regions of energy absorbing material may be provided between the hard shell and a head mount (described below). For example, a band of energy absorbing material may be provided around the lower edge of the outer shell and/or a section of energy absorbing material may be provided to be located above the top of the wearer's head.

In some example helmets, the outer layer 2 and/or the energy absorbing layer 3 may be adjustable in size in order to provide a customised fit. For example the outer layer 2 may be provided in separate front and back parts. The relative position of the front and back parts may be adjusted to change the size of the outer layer 2. In order to avoid gaps in the outer layer 2, the front and back parts may overlap. The energy absorbing layer 3 may also be provided in separate front and back parts. These may be arranged such that the relative position of the front and back parts may be adjusted to change the size of the energy absorbing layer 3. In order to avoid gaps in the energy absorbing layer 3, the front and back parts may overlap.

Figure 1:
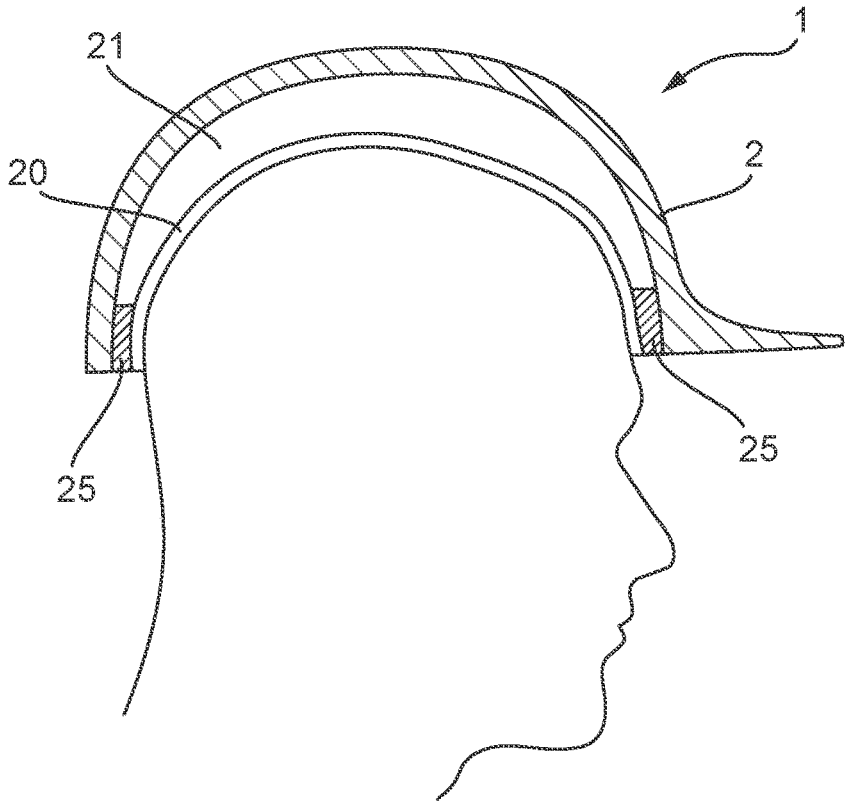
FIG. 1 schematically shows a cross-section through a first example helmet.

FIG. 1 shows an example helmet 1 comprising a head mount 20. Although not shown in FIGS. 2 to 4, these example helmets also comprise a head mount 20. The head mount 20 may be provided to mount the helmet 1 on the head of a wearer. In some arrangements, this may improve the comfort of the wearer.

The head mount 20 may be provided in any form that can function to contribute to mounting the helmet to the wearer's head. In some configurations, it may assist in securing the helmet 1 to the wearer's head but this is not essential. The head mount 20 may be configured to at least partially conform to the head of the wearer. For example, the head mount 20 may be elasticated and/or may comprise an adjustment mechanism for adjusting the size of the interface layer 20. In an arrangement, the head mount 20 may engage with the top of a wearer's head.

The head mount 20 may be removable. This may enable the head mount 20 to be cleaned and/or may enable the provision of an interface layer that is configured to fit a specific wearer.

As shown in FIG. 1 the head mount 20 is suspended within the rest of the helmet, e.g. a cavity formed therein for accommodating the head, (e.g. the outer shell 2 and/or optional energy absorbing layer 3) such that an air gap 21 is provided between the rest of the helmet and the head mount 20. The head mount 20 may be connected to the rest of the helmet (e.g. to the outer shell 2 and/or optional energy absorbing layer 3) by connectors 25. Helmets of this type are commonly used for industrial purposes, such as by builders, mine-workers or operators of industrial machinery. However, helmets based on such an arrangement may be used for other purposes.

In a helmet 1 such as that depicted in FIG. 1, the provision of an air gap 21 between the inner surface of the outer shell 2 and the head mount 20 is intended to ensure that loading caused by an impact on the outer shell 2 is spread across a wearer's head. In particular, the load is not localised on a point on the wearer's head adjacent the point of impact on the helmet 1. Instead, the load is spread across the outer shell 2 and, subsequently, spread across the head mount 20 and therefore spread across the wearer's skull.

During an impact, some of the energy of the impact may be absorbed by deformation of parts of the helmet, such as the head mount, reducing the size of the air gap. Accordingly, the size of the air gap 21 between the outer shell 2 and the head mount 20 may be chosen to ensure that, under an impact on the helmet below a threshold force that the helmet is designed to withstand, the head mount 20 does not come into contact with the outer shell 2, namely the air gap 21 is not entirely eliminated, such that the impact may be directly transferred from the hard shell to the head mount 20. However, in some example helmets, for impacts above the threshold force, the gap 21 may be eliminated, e.g. at a specification location such as the location of impact, such that the rest of the helmet contacts the head mount 20. Such example helmets may comprise an energy absorbing layer 3, which is provided in the space that would otherwise be empty and forming the air gap 21. In other words, part of the air gap 21 may be replaced by an energy absorbing layer. This may bring the rest of the helmet closer to the head mount 20.

In an arrangement, the helmet 1 may be configured such that, in the absence of an impact on the helmet, the separation between the outer shell 2 and the head mount 20 at a location corresponding to the top of the head of a wearer is at least 10 mm, optionally at least 15 mm, optionally at least 20 mm, optionally at least 30 mm, optionally at least 40 mm. The magnitude of the impact that the helmet 1 is designed to withstand, and therefore the size of the air gap 21, may depend upon the intended use of the helmet 1. It should be understood that, depending on the intended use of the helmet the size of the air gap 21 may be different at different locations. For example, the air gap 21 may be smaller at the front, back or side of the helmet than it is at the location corresponding to the top of the head of the wearer.

In arrangements that include energy absorbing layer, the energy absorbing layer may contribute to the helmet's ability to withstand radial impacts. In particular in arrangements in which the energy absorbing material is located within the air gap between the outer shell 2 and the head mount 20 at the location corresponding to the top of the wearer's head, it will be appreciated that the gap between the head mount and the surface of the energy absorbing layer will be smaller than the gap between the outer shell and the head mount, and may be eliminated altogether. Additionally, as a result of the energy absorbing material's contribution in the event of a radial impact, a smaller gap between the outer shell and the head mount may be required than would be the case in the absence of the energy absorbing material.

In some arrangements, the head mount 20 may include a head band, or head ring, that at least partially surrounds the wearer's head. Alternatively or additionally, the head mount 20 may include one or more straps that extend across the top of the wearer's head.

Alternatively or additionally, the head mount 20 may include a cap or shell that encapsulates an upper portion of the wearer's head. Straps or bands that form part of the head mount may be formed from Nylon fabric. Other materials may alternatively or additionally be used.

Figure 5:
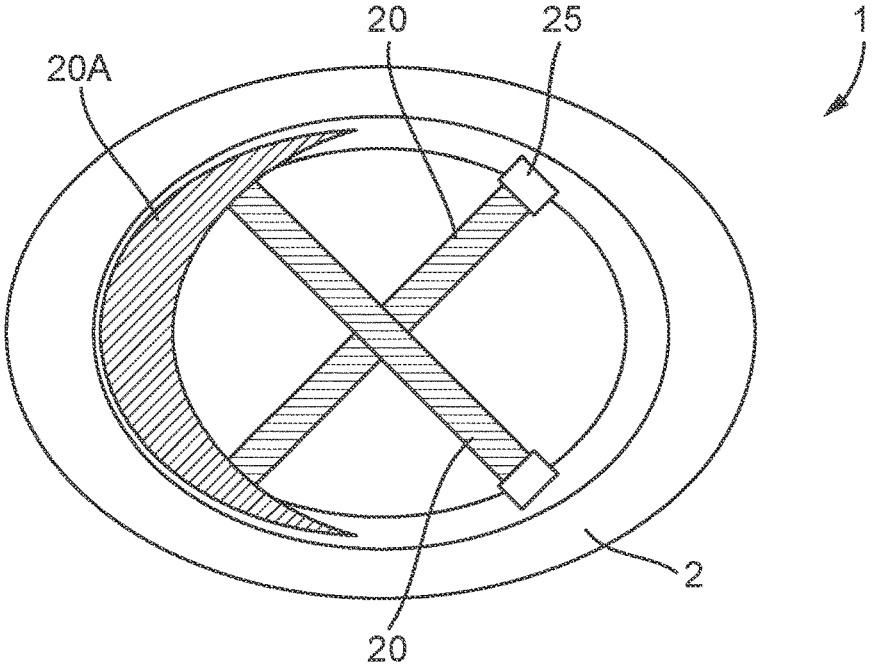
FIG. 5 schematically shows a first example head mount.
Figure 6:
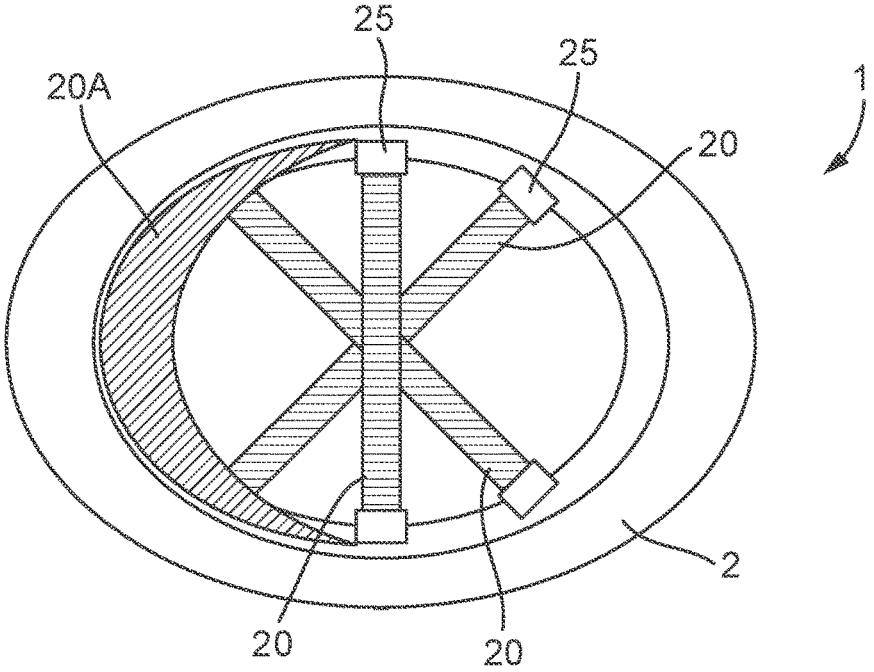
FIG. 6 schematically shows a second example head mount.
Figure 7:
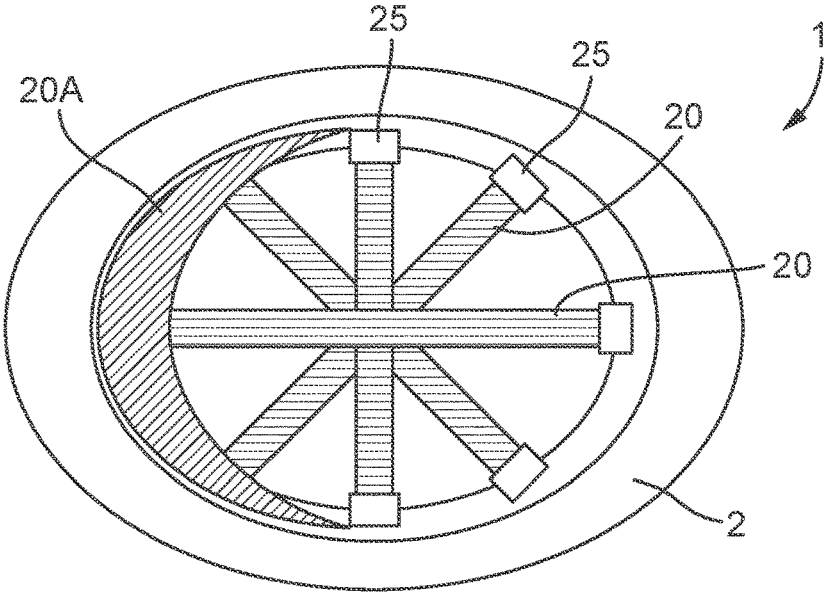
FIG. 7 schematically shows a third example head mount.

FIGS. 5 to 7 show example helmets the type schematically depicted in FIG. 1. As shown, the head mount includes a plurality of straps 20 that extend across the top of the head of a wearer of the helmet 1. The straps 20 may be connected at connection points to the outer shell 2 by any of a plurality of known methods. For example, the outer shell 2 may be moulded to include sockets into which connectors 25 may be inserted.

In the arrangement depicted in FIG. 5, the head mount is formed from two straps 20 that each extend between a pair of connectors 25 positioned such that the straps 20 extend across the head of the wearer of the helmet. For example, a first strap 20 may extend from a rear left position to a forward right position and a second strap 20 may extend from a rear right position to a forward left position. However, it should be appreciated that many other arrangements may be used. For example, additional straps may be provided, as shown in FIGS. 6 and 7, such that there are three, four or more straps extending across the top of the head of the wearer. As shown in FIG. 6, an additional strap is provided extending from left to right. As shown in FIG., 6 a further additional strap is provided extending from front to back. Similarly, the position of the connection points of the straps 20 to the remainder of the helmet 1 may be different from that depicted in FIGS. 5 to 7.

In an arrangement where different straps 20 are in proximity to each other, for example, at the top of the wearer's head, the straps 20 may not be connected to each other, permitting some movement of one strap relative to another. In other arrangements, the straps 20 may be connected to each other where they cross. In a further arrangement, the head mount may include one or more straps that extend from a connection point to the remainder of the helmet 1 to a point at which it is connected to other straps, for example, at a location corresponding to the top of the head of a wearer of the helmet. Finally, as noted above, in other arrangements, the head mount may be formed from components other than straps, for example from a cap or shell that can be mounted to the top of the head of the wearer of the helmet 1.

As shown in FIGS. 5 to 7, the head mount may include a head ring 20A that engages at least the forehead of a wearer of the helmet and may surround a portion of the head of the wearer. It should be appreciated that such a head ring 20A may be connected to the helmet 1 separately from the remainder of the head mount, such as straps 20. Alternatively, the head ring 20A may be connected to the helmet 1 by means of the straps 20. As a further alternative, the straps 20 may be connected to the rest of the helmet 1 by means of the head ring 20A.

Further straps, e.g. chin straps, may be provided to secure the helmet 1 to the head of the wearer.

Figure 8:
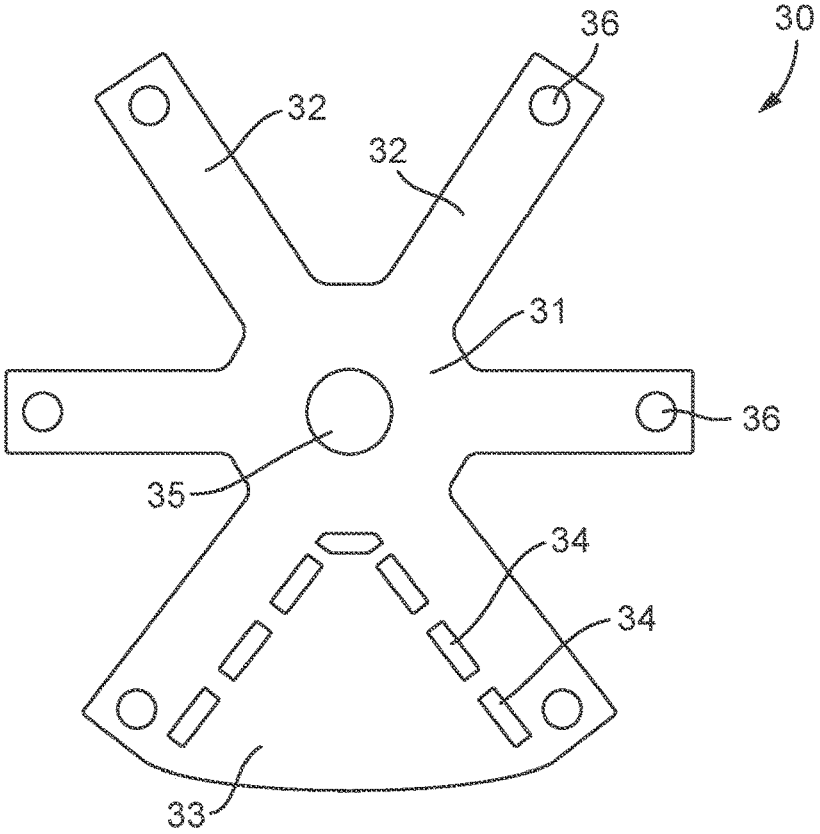
FIG. 8 schematically shows an example head mount cover.
Figure 9:
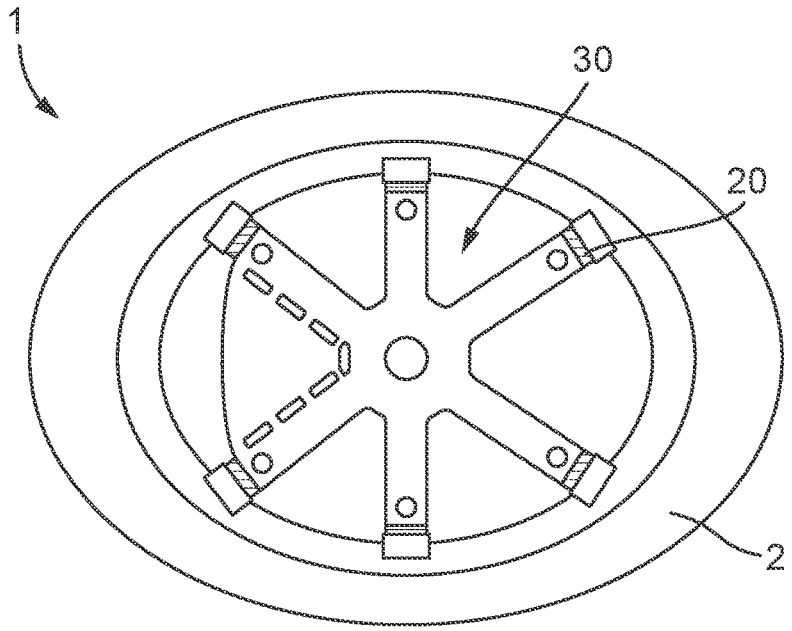
FIG. 9 schematically shows an example helmet comprising the head mount cover.

FIGS. 8 and 9 show an example device for use with a helmet as described above. The device is a head mount cover 30. The primary purpose of the head mount cover 30 is to provide a low friction interface that allows the head mount 20 to slide relative to the head of the wearer and/or to the rest of the helmet 1 (e.g. outer shell 2 and optional energy absorbing layer 3).

The purpose of helmet layers that move or slide relative to each other may be to redirect energy of an impact that would otherwise be transferred to the head the wearer. This may improve the protection afforded to the wearer against a tangential component of the impact energy. A tangential component of the impact energy would normally result in rotational acceleration of the head of the wearer. It is well know that such rotation can cause brain injury. It has been shown that helmets with layers that move relative to each other can reduce the rotational acceleration of the head of the wearer. A typical reduction may be roughly 25% but reductions as high as 90% may be possible in some instances.

Preferably, relative movement between helmet layers results in a total shift amount of at least 0.5 cm between an outermost helmet layer and an inner most helmet layer, more preferably at least 1 cm, more preferably still at least 1.5 cm. Preferably the relative movement can occur in any direction, e.g. in a circumferential direction around the helmet, left to right, front to back and any direction in between.

Regardless of how helmet layers are configured to move relative to each other, it is preferable that the relative movement, such as sliding, is able to occur under forces typical of an impact for which the helmet is designed (for example an impact that is expected to be survivable for the wearer). Such forces are significantly higher than forces that a helmet may be subject to during normal use. Impact forces tend to compress layers of the helmet together, increasing the reaction force between components and thus increasing frictional forces. Where helmets are configured to have layers sliding relative to each other the interface between them may need to be configured to enable sliding even under the effect of the high reaction forces experienced between them under an impact.

For the type of helmets 1 shown in FIGS. 1 to 7, during in impact to the helmet 1, the head mount 20 may remain suspended within the rest of the helmet 1. For example, an air gap 21 may be maintained. In that case, it may be advantageous to enable sliding between the head and the head mount 20. However, under particularly severe impacts, the rest of the helmet 1 may contact the head mound 20. In such circumstances, it may be advantageous that the head mount 20 is, alternatively or additionally, able to slide relative to the rest of the helmet 1.

As shown in FIG. 9, the head mount cover 30 is configured to cover at least first surface of the head mount 20. The first surface may be the surface facing the wearer's head or facing the rest of the helmet 1. The head mount cover 30 may additionally cover an opposing, second surface. The example shown in FIG. 9 covers first and second surfaces, corresponding to the surfaces facing the wearer's head and the rest of the helmet 1, respectively.

The head mount cover 30 may have a shape that corresponds to the shape of the head mount 20. As shown in FIGS. 8 and 9, in a case where the head mount 20 comprises a plurality of straps 20 that converge or cross, the head mount cover 30 may comprise a central region 31 located to correspond with a location of convergence or crossing of the straps 20, and a plurality of arms 32 extending outward from the central region 31 located to correspond with the plurality straps 20.

The head mount cover 30 may be provided as a single component, as shown in FIGS. 8 and 9. Alternatively, the head mount cover 30 may be formed from plural separate sections. For example, the central region 31 and each arm region 32 may be provided separately. Alternatively, the head mount cover 30 may comprise only arm regions, i.e. elongate sections. These may cover an entire strap 20 or cover part of each strap 20. For example one strap 20 may be covered by two elongate sections, e.g. arranged either side of a location of convergence or crossing of the straps 20.

As shown in FIG. 8, the head mount cover 30 may comprise a bridging section 33 extending across an area between two arms 32. The bridging section 33 may be located in a position corresponding to the front of the wearer's head. The bridging section 33 may substantially cover the entire gap. This may prevent the head of the wearer become lodged between the arms during impact. Vent holes 34 may be provided in the bridging section, to allow airflow, e.g. at an edge between the arms 32 and the bridging section 33.

The head mount cover 30 is also configured to at least partially surround the head mount 20, as shown in FIGS. 10 to 13. FIGS. 10 to 13 schematically shows a cross-section through a portion of the head mount cover 30 and head mount 20 shown in FIG. 9. Specifically, the cross-section shown is a transverse section through the extension axis of an arm potion 32.

As shown, the head mount cover 30 may have a layered construction. A first layer 37 may be provided to cover the first surface of the head mount 20. A second layer 38 may be provided to (at least partially) cover the opposite, second surface of the head mount 30. First and second layers 37, 38 may substantially overlap, for example, they may be substantially the same shape and size. Alternatively, the second layer, may be provided in a plurality of sections, e.g. strips, with gaps between. In another example, the second layer 38 may only cover a peripheral portion of the head mount 20, e.g. on opposite left and right sides, with reference to FIG. 10. Other arrangements are also possible.

The first and second layers of the head mount cover 30 may be connected, e.g. at edge portions 39. The first and second layers 37, 38 may be connected by adhesive, heat welding, stitching etc. As shown, the first and second layers 37, 38 may enclose a space 310, in which the head mount 20 is located.

The head mount cover 30 may be deformable, such that the head mount cover 30 can move relative to the head mount 20. The first and/or second layers 37, 38 of the head mount may be formed from a deformable material, for example a stretchable material. The first and/or second layers 37, 38 may be formed from a fabric, e.g. a stretchable fabric such as Lycra™. Alternatively, the first and second layers 37, 38 may be connected by a deformable material.

The bridging section 33 may be formed from the same materials as the first or second layers, for example. Alternatively, the bridging section 33 may have the same layered structure as the other parts of the head mount cover 30.

The first and second layers 37, 38 may themselves be multilayer materials. For example, these may comprise a base layer, e.g. a mesh, laminated with a comfort padding layer. This may be particularly advantageous for the layer arranged to face the wearer, for improved comfort.

As shown in FIG. 8, openings may be provided in the head mount cover 30, opening into the enclosed space 310. Accordingly, the head mount 20 can be inserted into and removed from the head mount cover through the openings. As shown in FIG. 8, one or more openings 35 may be provided in the central region 31 of the head mount cover 30 and one or more openings 36 may be provided at the distal end of each arm 32. To attach the head mount cover 30, the straps 20 may be threaded into the opening 35 and out of the opening 36, for example. Preferably, the openings 35, 36 are provided in the first or second layer not adjacent the sliding interface.

The head mount cover 30 is configured to provide a low friction interface between the head mount cover 30 and at least the first surface of the head mount 20. In examples where the head mount cover 30 covers first and second surfaces of the head mount 20, a low friction interface may be provided between the head mount cover 30 and both these surfaces of the head mount 20.

Figure 10:
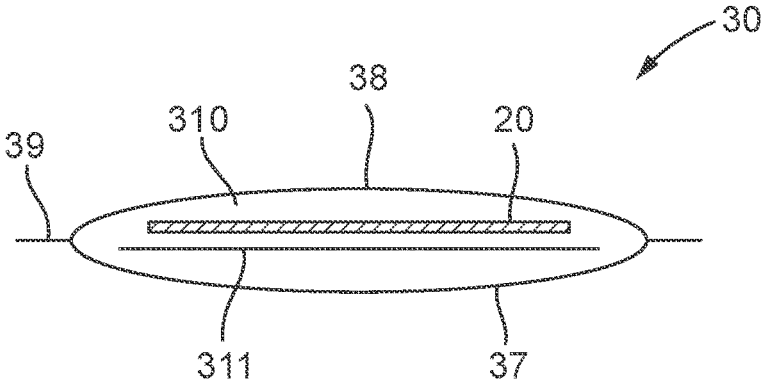
FIG. 10 schematically shows a section through an example head mount cover.

FIG. 10 shows an arrangement in which the low friction interface is provided by a third, intermediate layer 311 of low friction material between the first layer 37 of the head mount cover 30 and the head mount 20 (in use).

Possible low friction materials include waxy polymers such as PC, TPU, Nylon (e.g. brushed Nylon), PTFE, ABS, PVC, PFA, EEP, PE and UHMWPE, Teflon®.

Alternatively, the intermediate layer 311 may be formed from a woven or nonwoven fabric. The low friction interface may be provided between the intermediate layer 311 and one or both of the first layer 37 and head mount 20.

Such low friction materials may have a thickness of roughly 0.1-5 mm, but other thicknesses can also be used, depending on the material selected and the performance desired.

Figure 11:
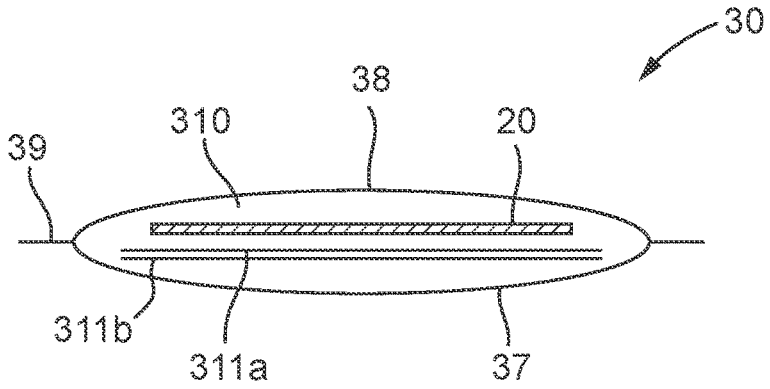
FIG. 11 schematically shows a section through an example head mount cover.

FIG. 11 shows a variation in which the low friction interface is provided by two (or more) intermediate layers 311*a* and 311*b* of low friction material between the first layer 37 of the head mount cover 30 and the head mount 20. The low friction interface may alternatively or additionally, be provided between the two intermediate layers 311*a*, 311*b*.

As shown in FIGS. 10 and 11, the intermediate layer 311 may be a floating layer, i.e. not attached to the rest of the head mount cover 20, but retained within the space 310. Alternatively, the intermediate layer may be fixed to a surface of the first layer 37, facing the intermediate layer 311, e.g. by an adhesive.

Figure 12:
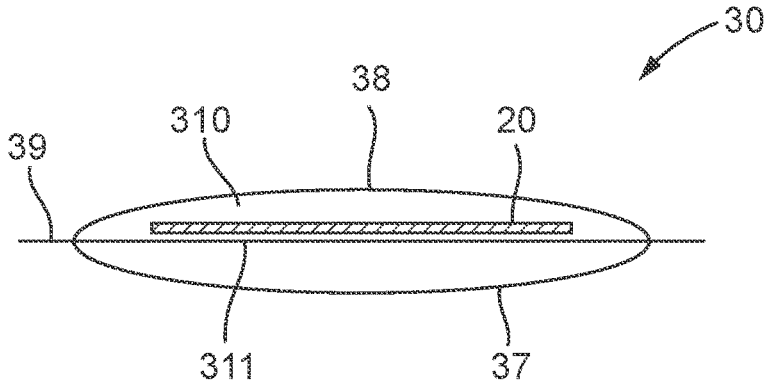
FIG. 12 schematically shows a section through an example head mount cover.

FIG. 12 shows a variation in which the intermediate later 311 is attached to the rest of the head mount cover 30 at the edge potions 39 that also connect the first and second layers 37, 38 together. The intermediate layer 311 may be sandwiched between the first and second layers 37, 38 at the edge portions 39. These layers may be connected by adhesive, heat welding, stitching etc. A particularly useful material for the intermediate layer 311 in this example may be TPU as this can act as an adhesive and a low friction layer.

Figure 13:
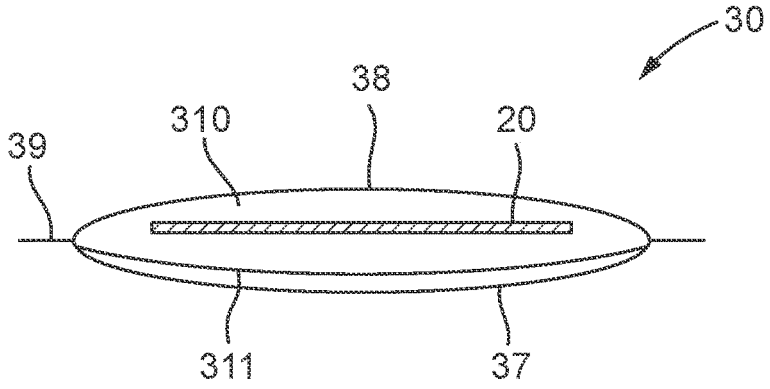
FIG. 13 schematically shows a section through an example head mount cover.

FIG. 13 shows a variation in which the first layer 37 and intermediate layer 311 comprise a ribbed fabric and are arranged such that the rib directions are perpendicular to each other, thus forming the low friction interface therebetween. Preferably, the ribbed fabric is a tricot fabric. Preferably, the tricot fabric has a dull side and a shiny side and the respective shiny sides face each other at the sliding interface.

Alternatively, or additionally, lubricating materials include oils, polymers, microspheres, or powders, or thereof may be used at the low friction interface.

In one example the low friction material or lubricating material may be a polysiloxane-containing material. In particular the material may comprise (i) an organic polymer, a polysiloxane and a surfactant; (i) an organic polymer and a copolymer based on a polysiloxane and an organic polymer; or (iii) a non-elastomeric cross-linked polymer obtained or obtainable by subjecting a polysiloxane and an organic polymer to a cross-linking reaction. Preferred options for such materials are described in WO2017148958.

In one example the low friction material or lubricating material may comprise a mixture of (i) an olefin polymer, (ii)

a lubricant, and optionally one or more further agents. Preferred options for such materials are described in WO2020115063.

In one example the low friction material or lubricating material may comprise an ultra high molecular weight (UHMW) polymer having a density of ≤960 kg/m$^3$, which UHMW polymer is preferably an olefin polymer. Preferred options for such materials are described in WO2020115063.

In one example the low friction material or lubricating material may comprise a polyketone.

In some arrangements, it may be desirable to configure the low friction interface such that the static and/or dynamic coefficient of friction between materials forming sliding surfaces at the sliding interface is between 0.001 and 0.3 and/or below 0.15. The coefficient of friction can be tested by standard means, such as standard test method ASTM D1894.

Figure 14:
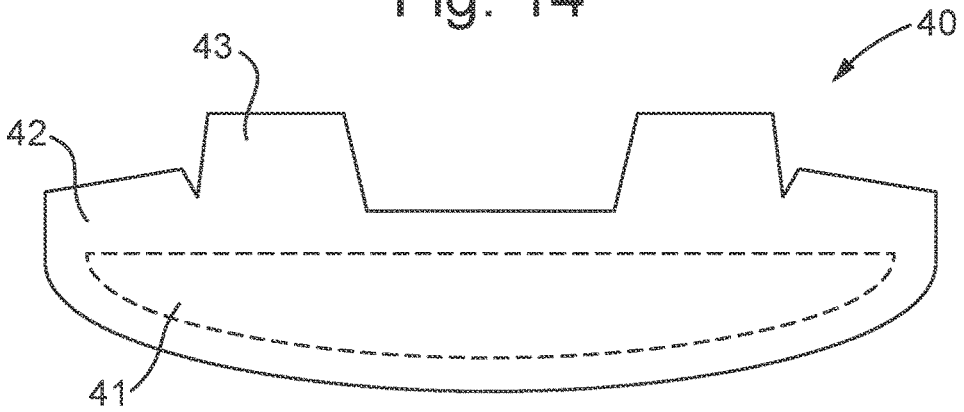
FIG. 14 schematically shows an example head mount cover.
Figure 15:
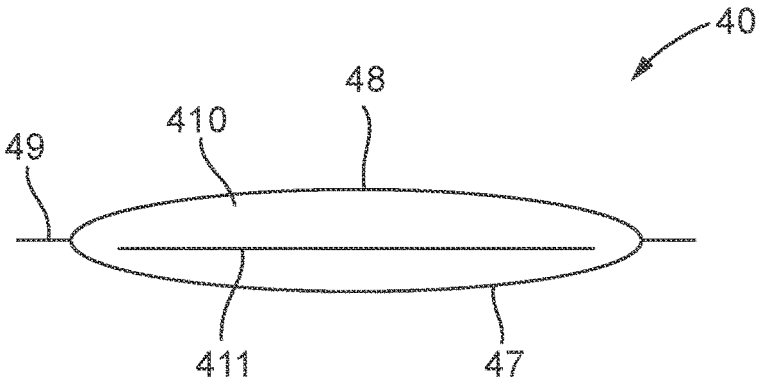
FIG. 15 schematically shows a section through an example head mount cover.
Figure 16:
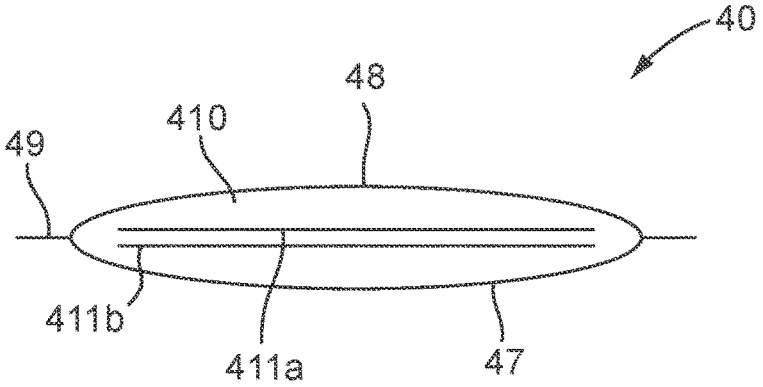
FIG. 16 schematically shows a section through an example head mount cover.
Figure 17:
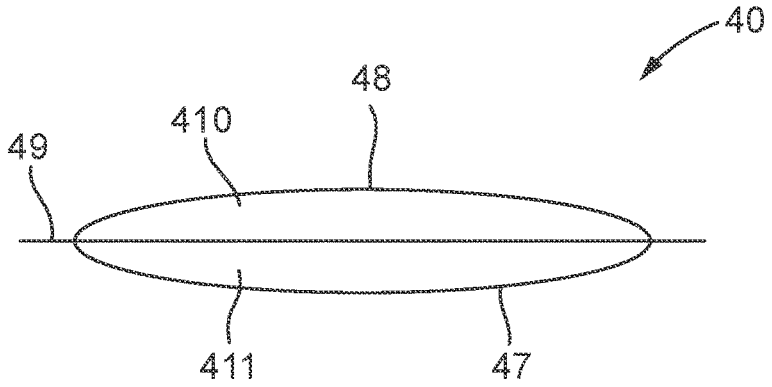
FIG. 17 schematically shows a section through an example head mount cover.
Figure 18:
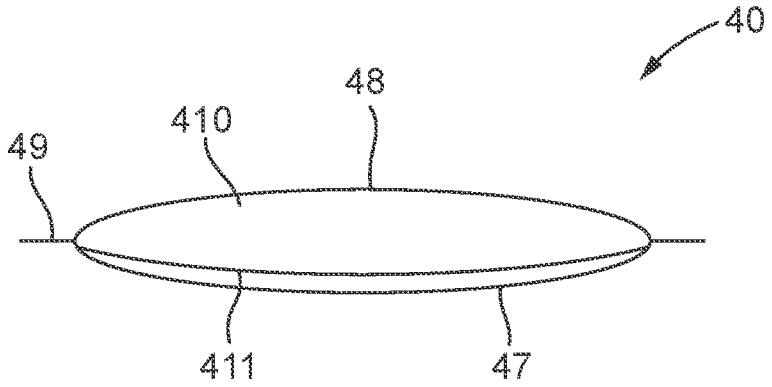
FIG. 18 schematically shows a section through an example head mount cover.

FIG. 14 shows a part 40, which may optionally form part of the head mount cover 30. The part 40 is configured to cover a head ring 20A. The head ring cover 40 may comprise a central region 41 providing the sliding interface and a peripheral portion 42 surrounding the central portion 41. In use, the central portion 41 may be arrange on first surface of the head ring 20A facing the wearer and the peripheral portion 42 may be configured to wrap around the head ring 20A.

The peripheral portion 42 may be attached to anchor points (such as hooks) on the second surface of the head ring 20A, opposite the first surface. To assist this, the peripheral apportion may include tabs 43 corresponding to the locations of the anchor points.

FIGS. 15 to 19 show cross-sections through example head ring covers. As shown in FIGS. 15 to 18, the head ring cover may have a similar layered construction to the examples shown in FIGS. 10 to 13, namely first and second layers 47, 48, optionally connected at an edge portion 49 and optionally defining an enclosed space 410. The head ring cover 40 may also comprise a third, intermediate layer 411, or two such layers 411A, 411B. In each of the examples, the low friction interface is provided within the head ring cover 40, between the first and second layers 47, 48.

Figure 19:
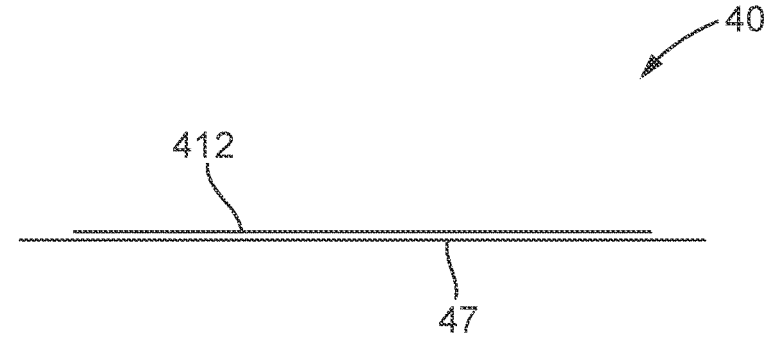
FIG. 19 schematically shows a section through an example head mount cover.

FIG. 19 shows a variation in which the low friction interface is provided at an outer surface of the head ring cover 40. In this example, the head ring cover may comprise a first layer 47 and a low friction layer 412 on a surface of the first layer facing the head ring 20A.

In alternative examples, not illustrated, the head ring cover 40 may be constructed as in FIGS. 15 to 18 and comprise an opening in the second layer 48 allowing the head ring cover to fit over the head ring 20A and be retained in the enclosed space 410.

Helmets as described above may be used in various activities. These activities include combat and industrial purposes, such as protective helmets for soldiers and hard-hats or helmets used by builders, mine-workers, or operators of industrial machinery for example. Helmets, are also common in sporting activities. For example, protective helmets may be used in ice hockey, cycling, motorcycling, motor-car racing, skiing, snow-boarding, skating, skate-boarding, equestrian activities, American football, baseball, rugby, soccer, cricket, lacrosse, climbing, golf, airsoft, roller derby and paintballing.

Examples of injuries that may be prevented or mitigated by the helmets described above include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational component of an impact, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

Variations of the above described examples are possible in light of the above teachings. It is to be understood that the invention may be practiced otherwise and specifically described herein without departing from the spirit and scope of the invention.

The invention claimed is:

1. A helmet, comprising:

an outer shell;

a head mount comprising a plurality of straps that are configured to extend across the top of the head of a wearer of the helmet, wherein the head mount is suspended within the outer shell such that, in use, an air gap is provided between the head mount and the outer shell; and a head mount cover, comprising a first layer covering a first surface of the head mount and a second layer at least partially covering a second surface of the head mount on an opposite side of the head mount to the first surface, wherein the first and second layers are directly connected to one another at respective edge portions, and at least one strap of the plurality of straps is located in a space between the edge portions;

wherein a sliding interface is provided between the head mount cover and the first surface of the head mount to allow the head mount to slide relative to the head of the wearer and/or to the rest of the helmet under an impact to the helmet.

2. The helmet of claim 1, wherein the head mount cover is deformable, such that the head mount cover can move relative to the head mount at the sliding interface.

3. The helmet of claim 1, wherein the first layer comprises a fabric;

wherein, optionally, the fabric is stretchable.

4. The helmet of claim 1, wherein the second layer comprises a fabric;

wherein, optionally, the fabric is stretchable.

5. The helmet of claim 1, wherein the head mount cover comprises a third layer arranged between the first layer and the first surface of the head mount, part of the sliding interface being provided by the third layer.

6. The helmet of claim 5, wherein the third layer comprises a polycarbonate (PC), TPU or Nylon material.

7. The helmet of claim 5, wherein the third layer comprises a fabric material.

8. The helmet of claim 7, wherein the first layer and the third layer of the head mount cover each comprise a ribbed fabric and the first layer and the third layer are arranged such that a rib direction of the first layer is perpendicular to a rib direction of the third layer, thus forming the sliding interface between the first layer and the third layer;

wherein, optionally, the ribbed fabric is a tricot fabric.

9. The helmet of claim 1, wherein the plurality of straps extend between an opposing pair of connection points;

wherein, optionally, at least two straps are connected to each other.

10. The helmet of claim 1, wherein the head mount cover surrounds each of the straps; wherein, optionally, the head mount cover comprises a central region, and a plurality of arms extending outward from the central region located to correspond with the plurality straps, the central region located to correspond with a location of convergence or crossing of the straps.

11. The helmet of claim 1, wherein the head mount cover comprises an opening through which the head mount can be inserted and/or removed.

12. The helmet of claim 1, wherein:

the head mount cover is provided as a single component; or wherein the head mount cover is formed from plural separate sections.

13. The helmet of claim 1, wherein the head mount comprises a head ring that is configured to engage at least the forehead of a wearer of the helmet; and the head mount cover comprises a frontal region that is configured to cover the head ring.

14. The helmet according to claim 1, wherein the head mount cover comprises one or more pads provided on a surface of the head mount cover configured to face the head of a wearer of the helmet.

15. The helmet according to claim 1, wherein, in the absence of an impact on the helmet, a separation distance between the outer shell and the head mount at a location corresponding to the top of the head of a wearer provided by the air gap is at least 10 mm, optionally at least 15 mm, optionally at least 20 mm, optionally at least 30 mm, optionally at least 40 mm.

* * * * *